US006024078A

United States Patent [19]

Hollis et al.

[11] Patent Number: 6,024,078

[45] Date of Patent: Feb. 15, 2000

[54] LAUNCHER AND METHOD FOR LAUNCHING DISK-SHAPED PROJECTILE IN EDGE-ON AND FACE-ON ORIENTATIONS

[75] Inventors: Michael Hollis, Abingdon; John Condon, Timonium, both of Md.

[73] Assignee: The United States of America as represented by the Secretary of the Army, Washington, D.C.

[21] Appl. No.: 09/137,872

[22] Filed: Aug. 17, 1998

[51] Int. Cl.[7] ..... F41B 4/00

[52] U.S. Cl. ..... 124/78

[58] Field of Search ..... 124/78

[56] References Cited

U.S. PATENT DOCUMENTS

| | | | |
|---|---|---|---|
| 4,026,261 | 5/1977 | Paulson et al. | 124/78 |
| 4,596,230 | 6/1986 | Griffith | 124/78 |
| 5,125,653 | 6/1992 | Kovacs et al. | 124/78 X |
| 5,464,208 | 11/1995 | Pierce | 124/78 X |
| 5,611,322 | 3/1997 | Matsuzaki et al. | 124/78 X |

FOREIGN PATENT DOCUMENTS

| | | | |
|---|---|---|---|
| 1221593 | 5/1987 | Canada | 124/78 |

*Primary Examiner*—John A. Ricci
*Attorney, Agent, or Firm*—Paul S. Clohan, Jr.; Mark D. Kelly

[57] ABSTRACT

A disk-shaped projectile can be launched in a variety of orientations including face-on and edge-on orientations. The launcher includes two spinning disks for receiving the projectile between them and imparting a force to the projectile. The angle between the axes of the disks can be set to zero or a non-zero value. The angle and the spin rates of the disks control the linear velocity and the spin rate of the projectile.

9 Claims, 6 Drawing Sheets

LAUNCHER AND METHOD FOR LAUNCHING DISK-SHAPED PROJECTILE IN EDGE-ON AND FACE-ON ORIENTATIONS

FIELD OF THE INVENTION

The invention is directed to a launcher and method for launching a short cylindrical disk such as a free flying magnetometer (FFM).

DESCRIPTION OF RELATED ART

A free flying magnetometer (FFM) is a lightweight (approximately 100 g maximum), short, cylindrical disk which contains a magnetometer, a power supply, sun sensors and a telemetry package.

One known device for launching an FFM is a prototype built and developed by Stanford University, called an Orbiting Pico-Satellite Automatic Launcher (OPAL). The OPAL includes a spinning platform with gripper-like appendages. First, the platform engages the FFM. Then a small motor spins the platform up to the desired launching spin rate. During this time, another motor, which turns a power-screw assembly, pushes the spinning platform to provide the desired forward linear velocity. The OPAL can launch an FFM in a face-on orientation, in which the linear movement is substantially parallel to the axis of rotation of the spinning platform, but not in an edge-on orientation, in which the linear movement is substantially perpendicular to the axis of rotation of the spinning platform.

Another known launcher for a disk-shaped projectile is disclosed in U.S. Pat. No. 5,579,750. The launcher disclosed in this reference provides the forward velocity with a catapult and provides the spin by engaging teeth or grooves inside the disk-shaped projectile. Such a launcher does not provide independent control of the angular and linear velocities and does not provide both face-on and edge-on launching.

A known launcher for hockey pucks is the "Boni" puck launching machine produced by Boni Goalie Trainers, Inc., of Ontario, Canada. This machine uses two spinning wheels to launch hockey pucks in an edge-on orientation only and is intended to provide practice for hockey players, especially the goal tender. The pucks have very little or no spin about the axis of symmetry, whereas such spin is desirable in launching an FFM.

Other known disk launchers tend to be either children's toys or clay-pigeon throwers. The latter typically include arms for catapulting the disks.

SUMMARY OF THE INVENTION

An object of the present invention is to launch short cylindrical disks in a variety of orientations including face-on and edge-on.

Another object of the invention is to launch short cylindrical disks from a space-based platform or an earth-launched rocket.

Still another object of the invention is to control the spin rate and linear velocity of the short cylindrical disks independently.

Yet another object of the invention is to launch FFMs or other projectiles without undue constraints on the external shapes of the FFMs or other projectiles.

To achieve these and other objects, the present invention is directed to a launcher for launching a projectile, the launcher comprising: a first drive wheel having a first axis and a second drive wheel having a second axis, the first and second drive wheels defining a space to receive the projectile; motive means for spinning the first drive wheel about the first axis and the second drive wheel about the second axis to impart a force on the projectile to launch the projectile; and gimbal means for varying an angle between the first and second axes such that the angle has a selected one of a plurality of values.

The present invention is further directed to a method of launching a projectile, the method comprising: (a) providing a first drive wheel having a first axis and a second drive wheel having a second axis, the first and second drive wheels defining a space to receive the projectile; (b) varying an angle between the first and second axes such that the angle has a selected one of a plurality of values; (c) providing the projectile in the space; and (d) spinning the first drive wheel about the first axis and the second drive wheel about the second axis to impart a force on the projectile to launch the projectile.

BRIEF DESCRIPTION OF THE DRAWINGS

A preferred embodiment of the present invention will be set forth in detail with reference to the drawings, in which.

DETAILED DESCRIPTION OF THE PREFERRED EMBODIMENT

Figure 1:
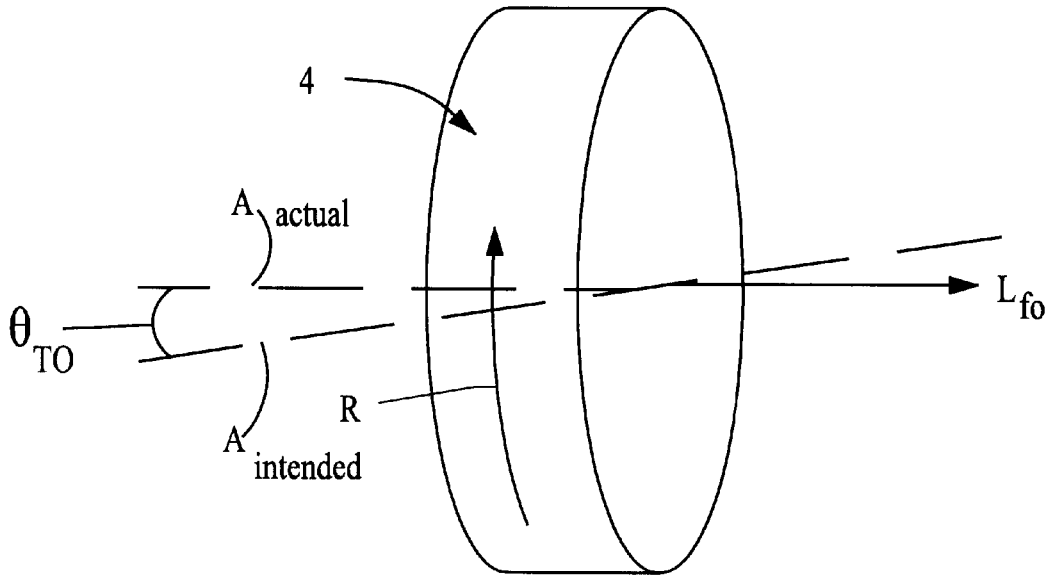
FIG. 1 shows the relationship between the linear velocity and the rotation of a projectile launched in the face-on orientation.

The concepts of the face-on and edge-on orientations will be explained with reference to FIGS. 1 and 2. FIG. 1 shows the relationship between the linear velocity and the rotation of a projectile launched in the face-on orientation, while FIG. 2 shows the relationship between the linear velocity and the rotation of the projectile launched in the edge-on orientation.

When the disk is launched face-on, as shown in FIG. 1, it has a rotation R, typically at a variable spin rate of 600–1, 200 rpm, thus defining axis of rotation $A_{actual}$ which coincides with the axis of symmetry of the disk. The disk also has linear velocity $L_{fo}$, typically with a variable speed of 1–10 m/s. In the face-on orientation, $L_{fo}$ and $A_{actual}$ are substantially parallel; in some applications, the maximum tip-off angle (angle $\theta_{to}$ between $A_{actual}$ and intended axis of rotation $A_{intended}$) caused by any disturbance must be less than 1°. The spinning of the disk provides stability in flight.

Figure 2:
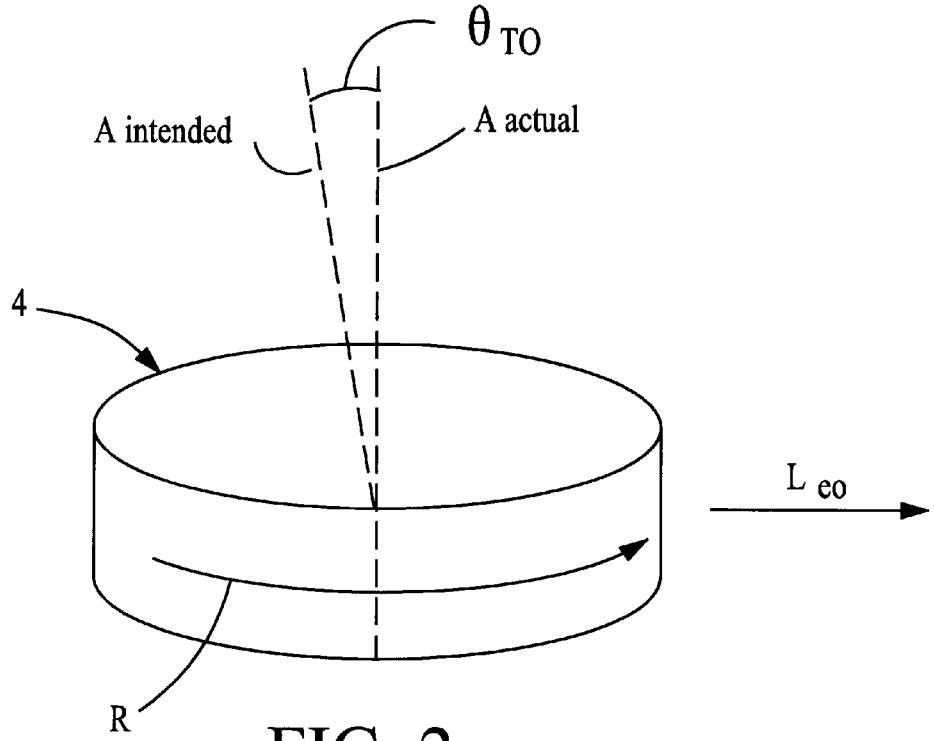
FIG. 2 shows the relationship between the linear velocity and the rotation of the projectile launched in the edge-on orientation.

When the disk is launched edge-on, as shown in FIG. 2, rotation R and axis of rotation $A_{actual}$ are the same as in FIG. 1. However, linear velocity $L_{eo}$ is substantially perpendicular to $A_{actual}$. Again, in some applications, the maximum tip-off angle must be less than 1°.

A basic mechanism for launching a disk at a variable orientation including face-on and edge-on uses two friction drive wheels and will be set forth with reference to FIGS. 3A–3C. This mechanism is particularly well suited to launching the FFM, which, because of its short cylindrical shape, the location of its sensors and other electronics and the intended trajectory, should be launched without disturbing the exterior shape.

Independently spinning drive wheels 1, 2 have rotations $R_1$, $R_2$ in opposite directions and are tilted about common axis 3 which runs through the centers of drive wheels 1, 2. Drive wheels 1, 2 have axes of rotation $A_1$, $A_2$ which are tilted from vertical in opposite directions by angles of the same magnitude β. Drive wheels 1, 2 are linked together by a mechanism to be described below such that their tilts are synchronized and have the same magnitude β.

Drive wheels 1, 2 are spaced apart so that adjacent peripheral portions are spaced apart by a distance equal to or slightly less than the diameter of disk or projectile 4, such as to receive disk 4 such that both of drive wheels 1, 2 contact disk 4. The rotations of drive wheels 1, 2 cause disk 4 to have rotation $R_4$ and linear velocity $L_4$.

Figures 4, 5:
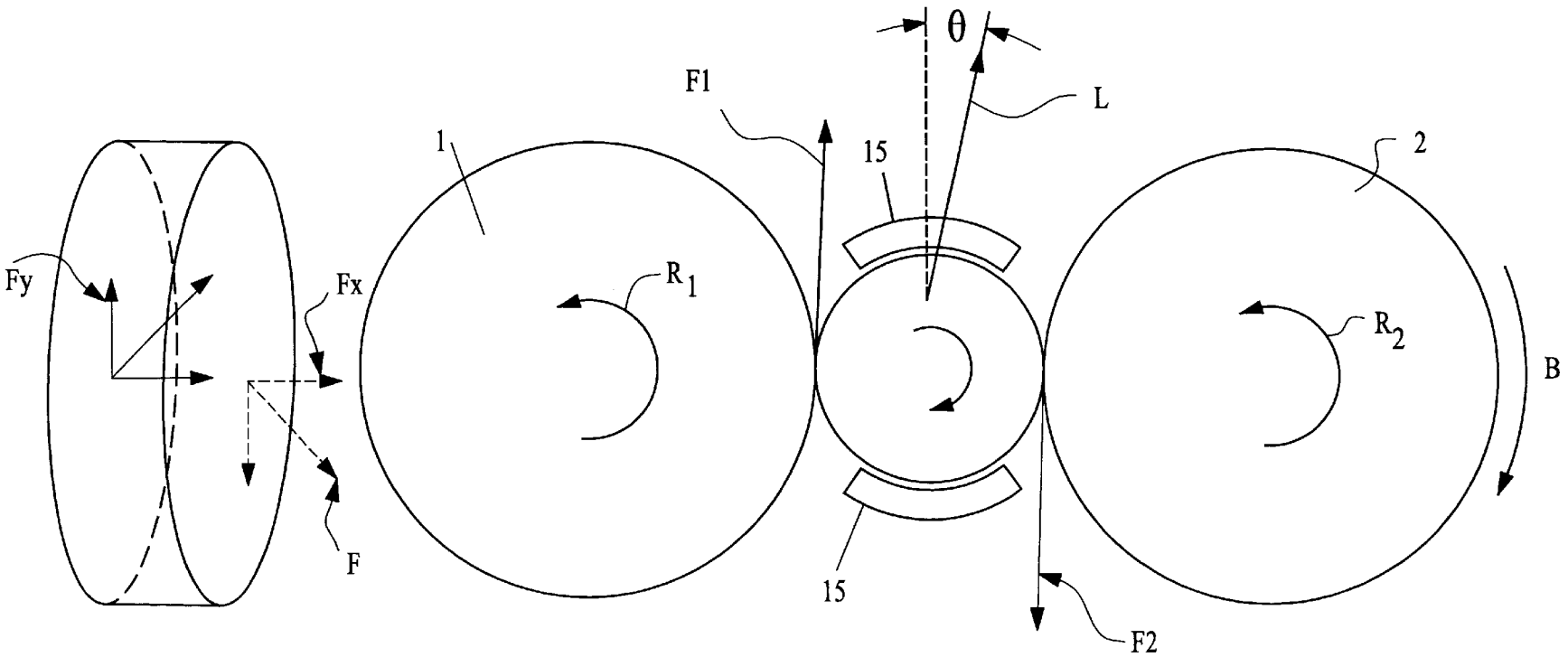
FIG. 4 shows a vector representation of forces applied to the projectile.
FIG. 5 shows the basic drive mechanism of FIGS. 3A–3C as reconfigured for launching the projectile in the edge-on orientation.

FIG. 4 shows a vector representation of the forces applied to disk 4 by drive wheels 1, 2. The diagonal arrows represent contact forces F due to drive wheels 1, 2, while the orthogonal arrows represent the breakdown of contact forces F into x components $F_x$, which give disk 4 its linear velocity, and y components $F_y$, which give disk 4 its angular velocity. Thus, altering the spin rates of drive wheels 1, 2 and magnitude β of their tilt angles, or altering only β, allows $R_4$ and $L_4$ to be controlled independently and provides a broad range of linear and angular velocities for disk 4. Two contemplated combinations of linear and angular velocities are 10 m/s with 1,200 rpm and 1 m/s with 600 rpm. The spin provides gyroscopic stability of disk 4 while in flight.

Figure 3A:
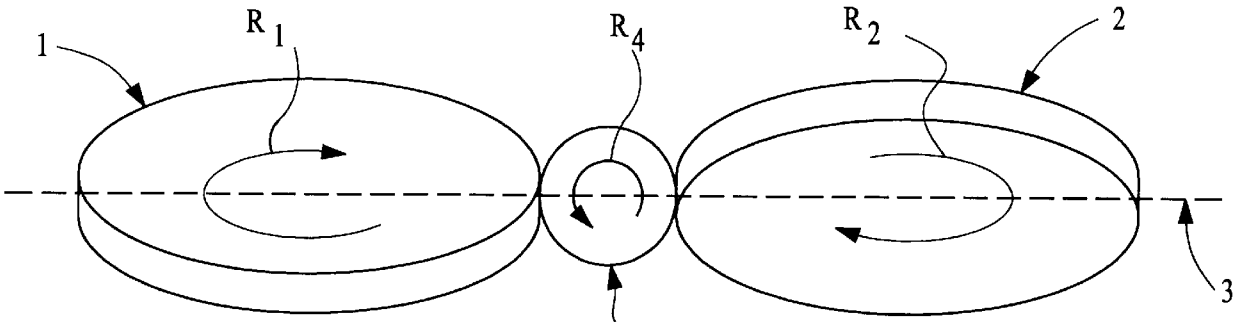
FIG. 3A shows a head-on view of a basic drive mechanism according to a preferred embodiment of the invention.
Figure 3B:
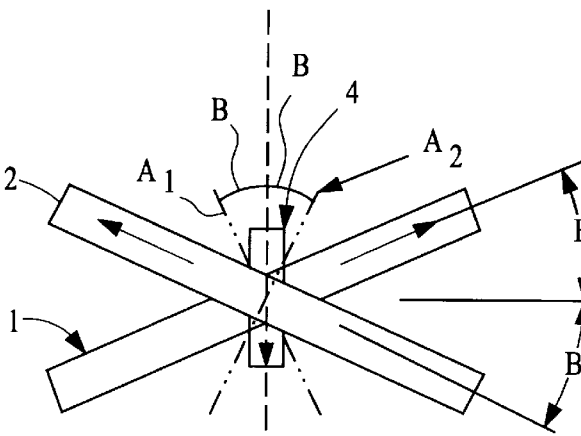
FIG. 3B shows a side view of the basic drive mechanism of FIG. 3A.
Figure 3C:
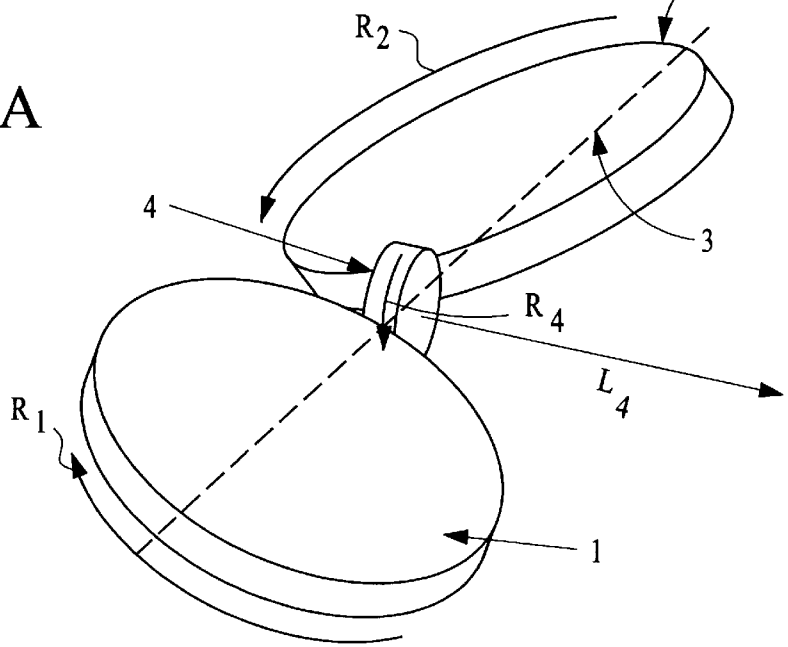
FIG. 3C shows a perspective view of the basic drive mechanism of FIG. 3A.

FIG. 5 shows the same basic mechanism as in FIGS. 3A–3C reconfigured for launching disk 4 in the edge-on orientation. In this configuration, β is substantially equal to zero, and drive wheels 1, 2 spin in the same direction about parallel axes.

First, disk 4 is placed between drive wheels 1, 2 either by rotating drive wheels 1, 2 in the opposite directions to draw in disk 4 or by use of a spring-loaded, pneumatic or other shuttle. Once disk 4 is between drive wheels 1, 2, gate 15 holds disk 4 in place. Gate 15 preferably has very low friction. Drive wheels 1, 2 are then spun to the desired spin rate and thus apply forces $F_1$, $F_2$ to opposite sides of disk 4. Once this desired spin rate is achieved, drive wheel 2 is braked as indicated by B. At the same time, gate 15 is removed. The braking causes an imbalance of forces between drive wheels 1, 2, which drives disk 4 out from between drive wheels 1, 2 with linear velocity L which is at angle θ. Linear velocity L can be varied by varying the braking deceleration.

Figure 6A:
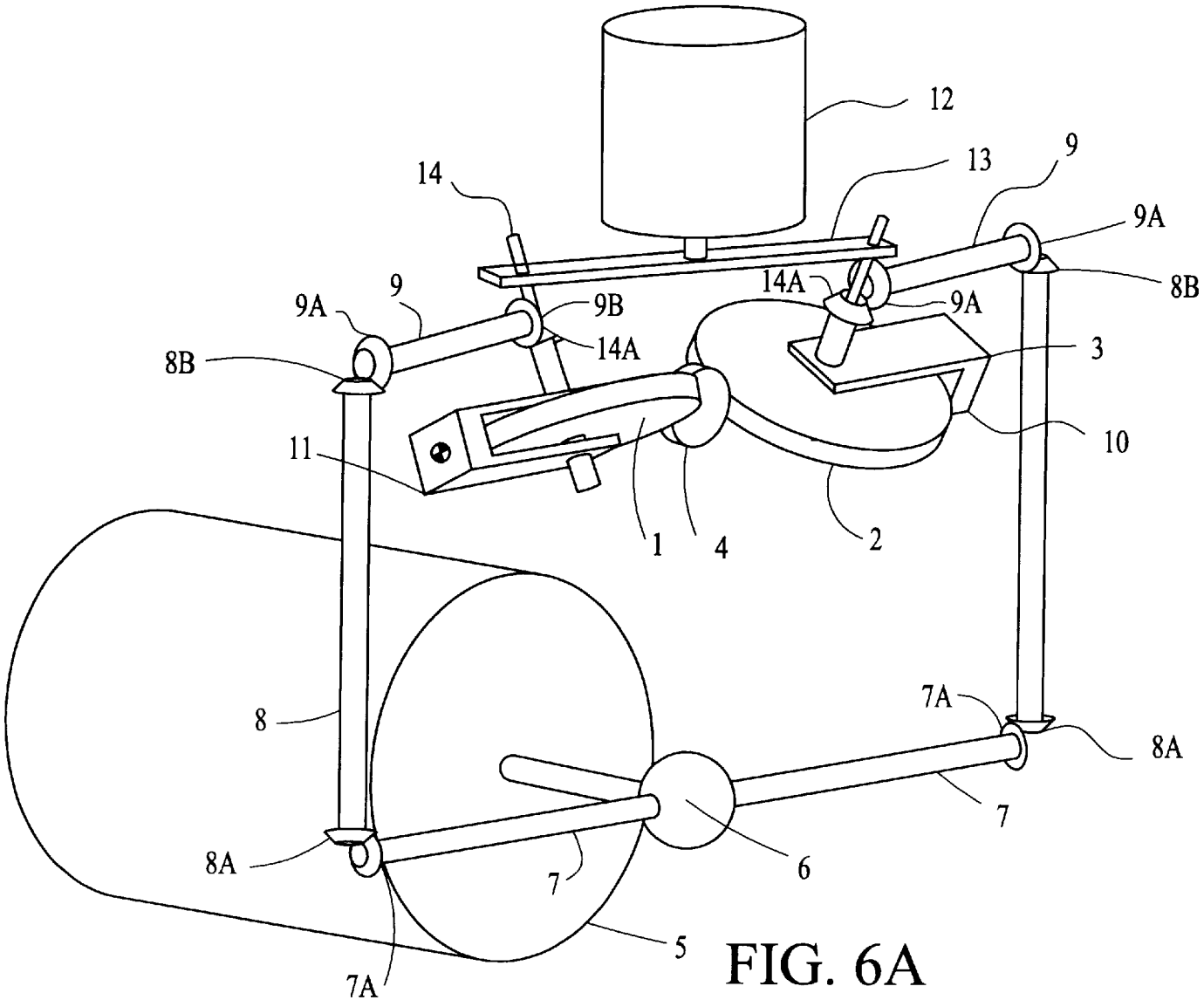
FIG. 6A shows an isometric view of a launcher incorporating the basic drive mechanism of FIGS. 3A–3C and 5.
Figure 6C:
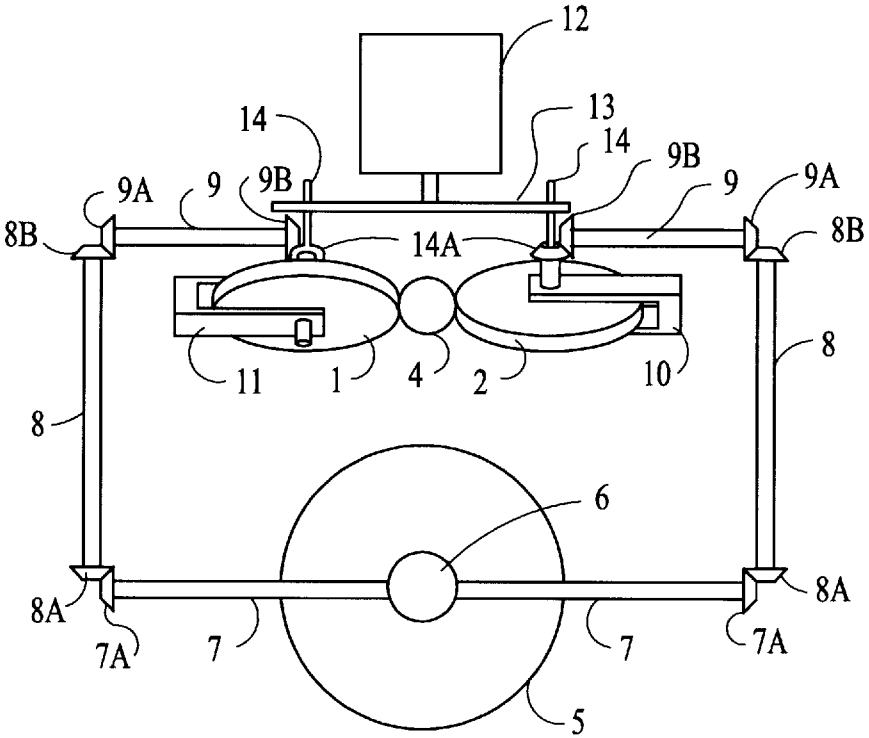
FIG. 6C shows a front view of the launcher of FIG. 6A.
Figure 6B:
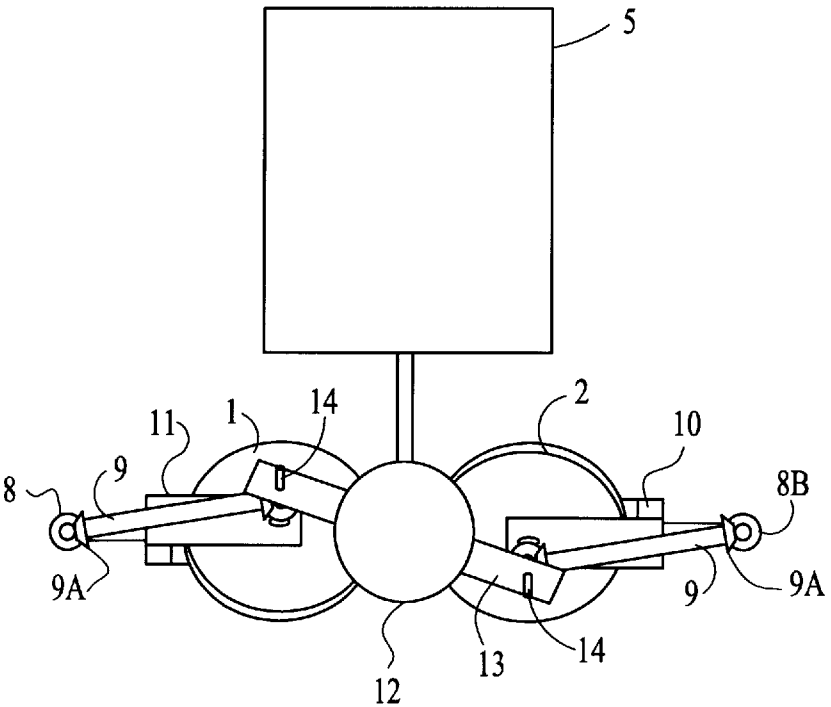
FIG. 6B shows a top view of the launcher of FIG. 6A.

The launcher incorporating the drive mechanism set forth above will now be set forth with reference to FIGS. 6A–6C and 7. FIGS. 6A–6C show isometric, top and front views of the launcher configured for face-on launching, while FIG. 7 shows an isometric view of the launcher configured for edge-on launching.

As shown in FIGS. 6A–6C, drive wheels 1, 2 have equal and opposite cant angles about common axis 3. Gimbal forks 10, 11 restrict the motion of drive wheels 1, 2 such that drive wheels 1, 2 gimbal only about common axis 3. Gimbal cross-arm 13 is driven by stepper motor 12 to control the gimbal angles of drive wheels 1, 2 by pushing axles 14 of drive wheels 1, 3 by equal and opposite amounts. This control is seen especially clearly in FIG. 6B.

Drive wheels 1, 2 can be driven by separate motors or by single motor 5. In the latter case, motor 5 can have a final drive including differential 6 which splits the motive power supplied by motor 5 to two axles 7. Each axle 7 has bevel gear 7A for supplying motive power to a corresponding one of drive wheels 1, 2 through bevel gear 8A, axle 8, bevel gears 8B, 9A, axle 9 and bevel gears 9B, 14A.

Figure 7:
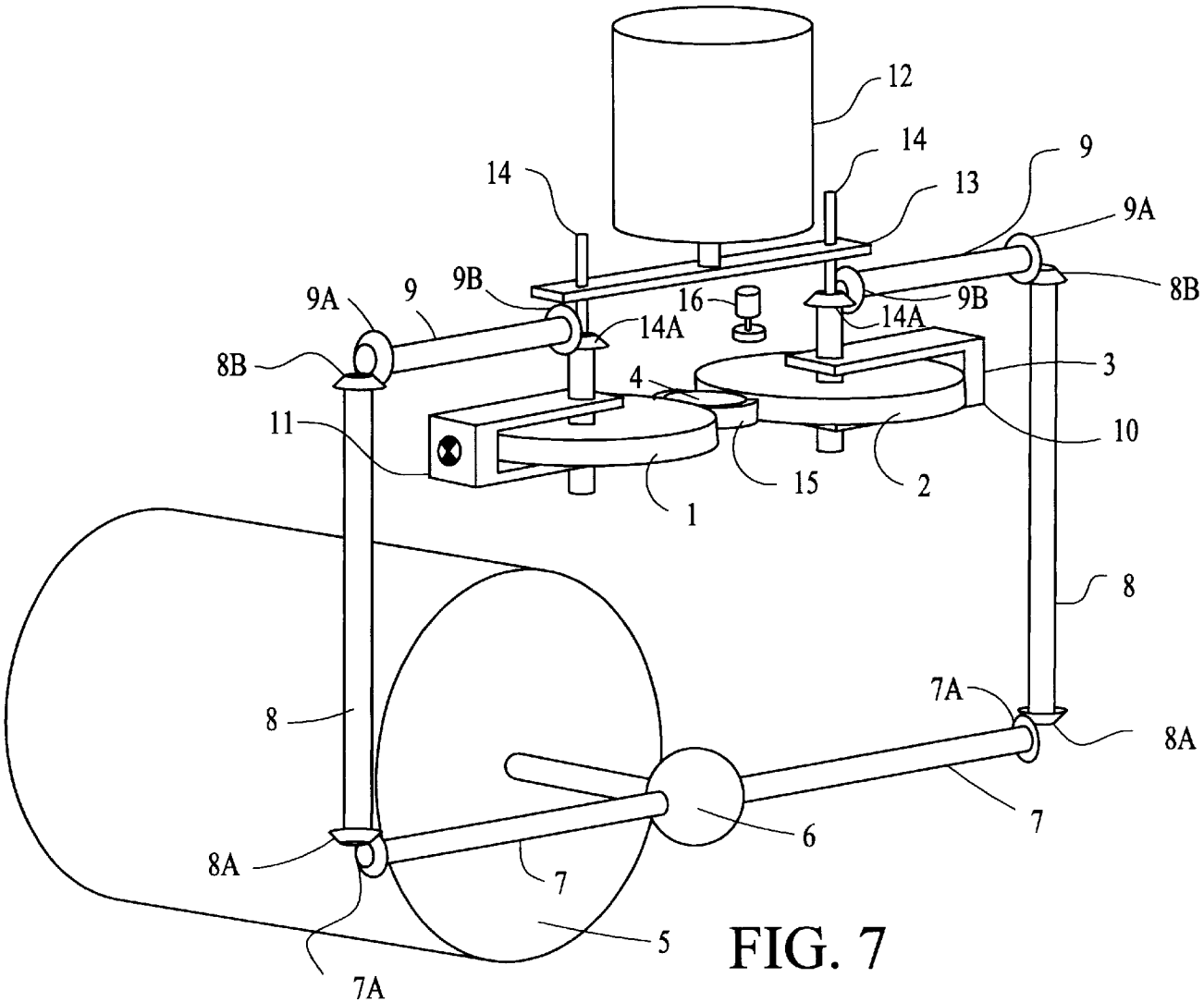
FIG. 7 shows the launcher of FIGS. 6A–6C configured to launch the projectile in the edge-on orientation.

FIG. 7 shows the same launcher configured to launch disk 4 in the edge-on configuration. Gate 15 and brake 16 for braking drive wheel 2, which were omitted for clarity in FIGS. 6A–6B, are shown in FIG. 7. Drive wheels 1, 2 have been canted to β=0 through the operation of stepper motor 12 and gimbal cross-arm 13. Disk 4 has been inserted in the proper orientation for edge-on launching. The direction of spin for drive wheel 2 could be controlled in differential 6 or in a separate transmission inserted anywhere between differential 6 and drive wheel 2.

While a preferred embodiment of the invention has been set forth above, those skilled in the art who have reviewed this disclosure will readily appreciate that other embodiments can be realized within the scope of the invention. For example, the launcher is not limited to face-on and edge-on launching or to the launching of disks, but can be used for launching a disk or other projectile, such as a spherical projectile, at any angular orientation. Also, any suitable mechanism for driving drive wheels 1, 2 can be used, as can any suitable mechanism for canting drive wheels 1, 2 to equal and opposite angles or to any other desired angles. Moreover, the projectile can be an FFM or any other projectile used for sports training, recreation or any other purpose.

We claim:

1. A launcher for launching a disk-shaped projectile, the launcher comprising:

(a) means for launching said projectile alternately in a first mode comprising an edge-on orientation of said projectile and a second mode comprising a face-on orientation of said projectile; and (b) means for varying a spin rate of said projectile independently of a linear velocity of said projectile.

2. A launcher for a projectile, comprising:

a first drive wheel having a first axis and a second drive wheel having a second axis, the first and second drive wheels defining a space to receive the projectile;

motive means for spinning the first drive wheel about the first axis and the second drive wheel about the second axis to impart a force on the projectile to launch the projectile; and means for varying an angle between the first and second axes such that the angle has a selected one of a plurality of values;

wherein the means for varying said angle is a gimbal means which comprises:

a first gimbal for holding the first drive wheel and for allowing the first drive wheel to pivot only about a common axis which connects a center of the first drive wheel with a center of the second drive wheel; and a second gimbal for holding the second drive wheel and for allowing the second drive wheel to pivot only about the common axis;

wherein the gimbal means further comprises a gimbal arm engaged with axles of the first and second drive wheels such that a movement of the gimbal arm pushes the axles and thus moves the first and second axes.

3. A launcher as in claim 2, wherein the gimbal means further comprises a stepper motor attached to the gimbal arm for causing the movement of the gimbal arm.

4. A launcher as in claim 3, wherein the stepper motor is attached to the gimbal arm such that the movement of the gimbal arm pushes the axles by equal amounts in opposite directions.

5. A launcher as in claim 2, wherein the motive means comprises means for controlling the first and second drive wheels to spin in a common direction.

6. A launcher for a projectile, comprising:

a first drive wheel having a first axis and a second drive wheel having a second axis, the first and second drive wheels defining a space to receive the projectile;

motive means for spinning the first drive wheel about the first axis and the second drive wheel about the second axis to impart a force on the projectile to launch the projectile; and means for varying an angle between the first and second axes such that the angle has a selected one of a plurality of values;

wherein the motive means comprises means for controlling the first and second drive wheels to spin in a selected one of (i) opposite directions and (ii) a common direction, further comprising a brake for applying a braking force to the second drive wheel.

7. A launcher as in claim 6, further comprising a removable gate for holding the projectile in the space.

8. A method of launching a projectile, the method comprising:

(a) providing a first drive wheel having a first axis and a second drive wheel having a second axis, the first and second drive wheels defining a space to receive the projectile;

(b) varying an angle between the first and second axes such that the angle has a selected one of a plurality of values;

(c) providing the projectile in the space; and (d) spinning the first drive wheel about the first axis and the second drive wheel about the second axis to impart a force on the projectile to launch the projectile, wherein step (b) comprises setting the angle to equal zero when the projectile is to be launched in an edge-on orientation;

wherein step (d) comprises selecting spin rates of the first and second drive wheels to provide the projectile with a desired non-zero linear velocity and a desired non-zero spin rate;

wherein step (d) further comprises retaining the projectile with a gate while the force is imparted on the projectile and moving the gate to release the projectile.

9. A method as in claim 8, wherein step (d) further comprises braking one of the first and second drive wheels when the gate is moved to release the projectile.

* * * * *